United States Patent [19]

Marconi

[11] Patent Number: 4,754,240

[45] Date of Patent: Jun. 28, 1988

[54] PIN DIODE ATTENUATORS

[75] Inventor: Franco Marconi, Monza, Italy

[73] Assignee: GTE Telecomunicazioni, S.p.A., Cassina de Pecchi, Italy

[21] Appl. No.: 927,622

[22] Filed: Nov. 6, 1986

[30] Foreign Application Priority Data

Nov. 20, 1985 [IT] Italy ..... 22923 A/85

[51] Int. Cl.[4] ..... H01P 1/22

[52] U.S. Cl. ..... 333/81 A; 333/262

[58] Field of Search ..... 333/81 A, 81 R, 35, 333/33, 117, 103, 104, 262, 245, 246, 238, 164

[56] References Cited

U.S. PATENT DOCUMENTS

| | | | |
|---|---|---|---|
| 2,096,027 | 10/1937 | Bode | 333/81 A X |
| 3,289,120 | 11/1966 | Anders et al. | 333/81 R |
| 3,775,708 | 11/1973 | Sly | 333/81 A |
| 3,859,609 | 1/1975 | Couillon et al. | 333/81 A |
| 4,267,538 | 5/1981 | Assal et al. | 333/33 X |
| 4,517,535 | 5/1985 | Pon | 333/81 A |

FOREIGN PATENT DOCUMENTS

| | | | |
|---|---|---|---|
| 0123643 | 10/1978 | Japan | 333/81 A |
| 0010647 | 1/1979 | Japan | 333/81 R |
| 0044314 | 3/1982 | Japan | 333/81 R |
| 0915138 | 3/1982 | U.S.S.R. | 333/81 R |

*Primary Examiner*—Eugene R. LaRoche
*Assistant Examiner*—Seung Ham
*Attorney, Agent, or Firm*—David N. Caracappa

[57] ABSTRACT

A pin diode variable attenuator featuring decouping values higher than those achievable using the technique used so far, is described. This result has been achieved by implementing the line sections which the pin diodes are connected to with a characteristic impedance different than the characteristic impedance input and output to/from the attenuator.

16 Claims, 3 Drawing Sheets

PIN DIODE ATTENUATORS

DESCRIPTION

The present invention refers to a microwave variable attenuator including line sections and variable attenuator means and presenting a first characteristic impedance at its input and its output.

It is known that in microwave circuits variable attenuators are used and that pin diodes can be used for their implementation.

It is also known that pin diodes present a radio-frequency resistance which is a function of the dc bias current flowing through them.

It is also known that in pin diodes unwanted elements are present, including junction capacitance, case capacitance and chip-to-case connection inductance, which limit their performances. In particular, in series connections these unwanted elements limit the maximum decoupling achievable, whereas they result in insertion losses in parallel connections.

It is finally known that an attenuator is as much better as its decoupling is greater and its insertion loss is lower and that, to achieve higher decoupling values, two or more pin diodes are used at a mutual distance of $\lambda/4$. However, the decoupling values achievable using this solution are not enough if high attenuations are desired, furthermore this solution results in using many pin diodes, which means increased costs and circuit dimensions.

Therefore, the purpose of the present invention is to obviate the said drawbacks and to indicate such a pin diode attenuator as to permit to achieve very high decoupling values or, decoupling being equal, to permit to use a reduced humber of pin diodes, which results in saving costs and reducing circuit dimensions and/or to pin to decrease the dc bias current variation range, which results in reduced consumption and stress for the pin diodes used. A further advantage resulting from a reduced dc bias current variation range is in that the linearizer networks for the said current can be simplified.

To achieve the said purposes, the object of the present invention is a microwave variable attenuator including line sections and variable attenuator means and presenting a first characteristic impedance at its input and its output, characterized by the fact that the said variable attenuator means are connected to line sections presenting a second characteristic impedance other than the first characteristic impedance.

Figure 1:
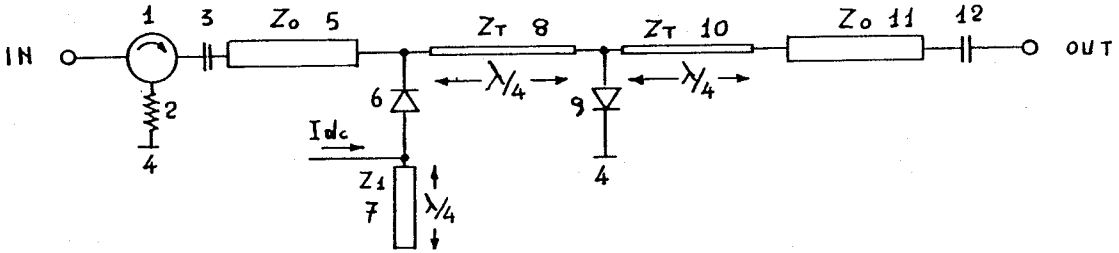
Figure 2:
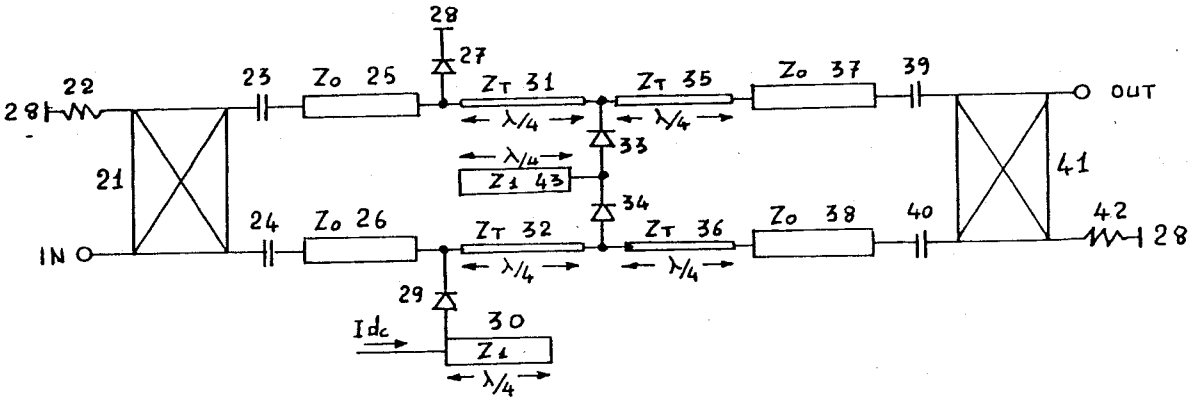
Figure 3:
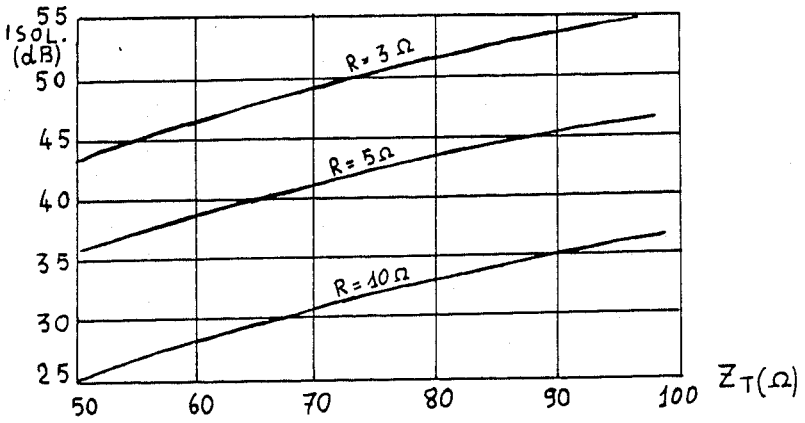
Figure 6:
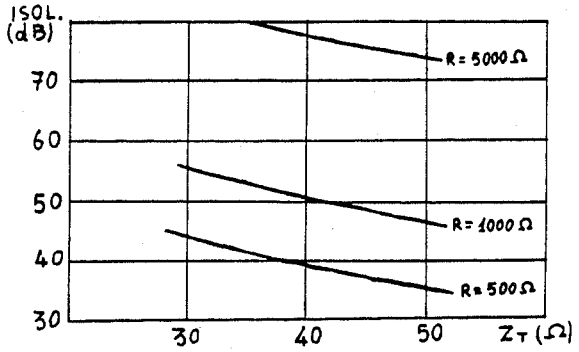
Figure 4:
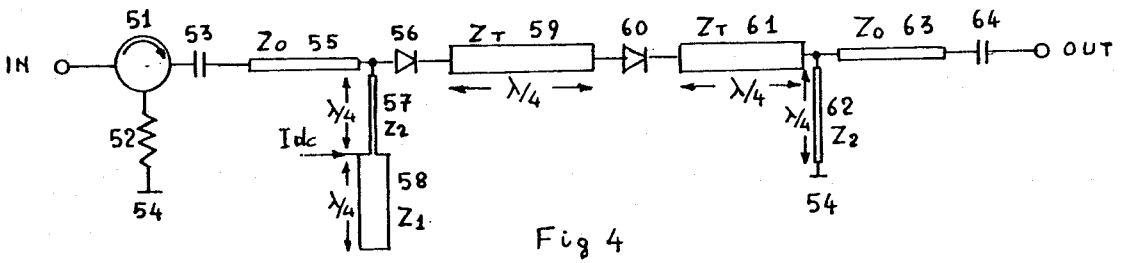
Figure 5:
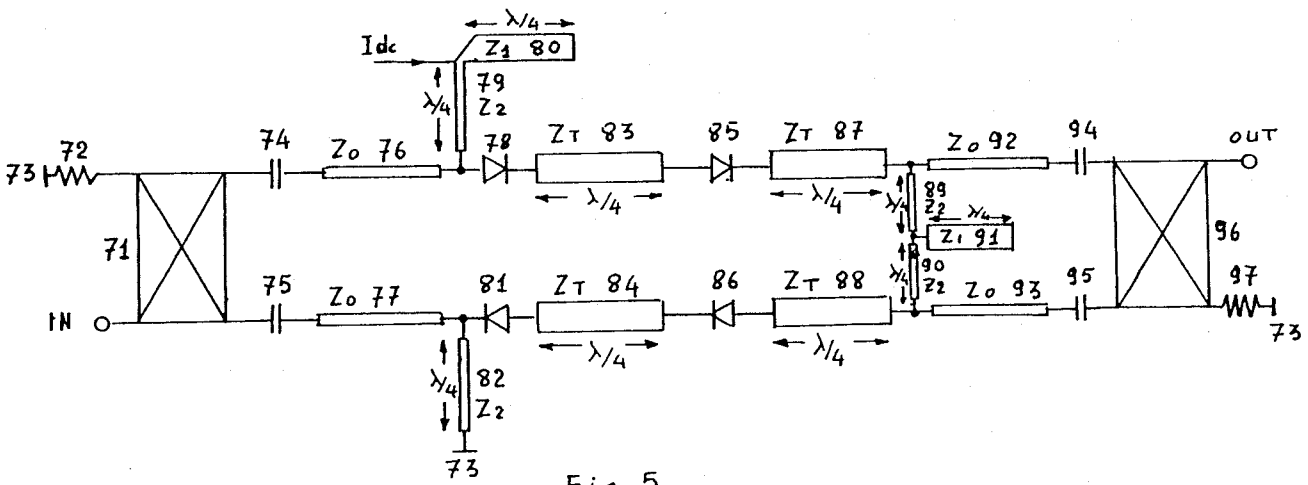

Further purposes and advantages of the present invention will appear clear from the detailed description which follows and the attached drawings, which are given on a purely explanatory and non restrictive basis, in which:

FIG. 1 shows a circuit diagram of a first embodiment of the pin diode attenuator object of the present invention, FIG. 2 shows a circuit diagram of a second embodiment of the pin diode attenuator object of the present invention, FIG. 3 shows a diagram relevant to the decoupling for the circuits in FIGS. 1 and 2, FIG. 4 shows a circuit diagram of a third embodiment of the pin diode attenuator object of the present invention, FIG. 5 shows a circuit diagram of a fourth embodiment of the pin diode attenuator object of the present invention, and FIG. 6 shows a diagram relevant to decoupling for circuits in FIGS. 4 and 5.

In FIG. 1, which shows a variable attenuator using pin diodes connected in parallel to each other, there are a separator 1, to the input port IN of which the radiofrequency input signal is fed, to the central port of which a matched load terminal 2 is connected and to the output port of which a dc seperator 3 is connected. The second terminal of the matched load 2 is connected to a ground 4 of the circuit, while the other terminal of separator 3 is connected to an end of a line section 5, having a characteristic impedance $Z_0$ of 50 ohms. The second end of line section 5 is connected to the cathode of a pin diode 6. Pin diode 6 and the remaining pin diodes which will be mentioned in the rest of this description are manufactured by Hewlett Packard, type HPND4011, and their operating characteristics are included in document "Applications of pin diodes, diode and transistor designer's catalog 1984–85" issued by Hewlett Packard. The anode of the pin diode 6 is connected to a line section 7 whose length is $\lambda/4$ and the characteristic impedance is $Z_1$, less than $Z_O$, which makes up a short circuit and consequently a virtual ground for radio-frequency, and is powered from a dc bias current $I_{dc}$, for which line section 7 represents an open circuit. The cathode of pin diode 6 is also connected to an end of line section 8 having a length of $\lambda/4$ and a characteristic impedance $Z_T$, the second end of which is connected to the anode of a pin diode 9 and to an end of a line section 10, also $\lambda/4$ and having a characteristic impedance $Z_T$. The cathode of pin diode 9 is connected to ground 4 of the circuit, while the second end of line section 10 is connected to an end of a line section 11 having a characteristic impedance $Z_O$. The second end of line section 11 is connected to a port of a dc separator 12, at the other port OUT of which the radio-frequency output signal is available.

In FIG. 2, which illustrates a variable attenuator using pin diodes connected in parallel according to a balanced structure, the radiofrequency input signal enters port IN of a power divider 21, at 90° and 3 dB.

To the remaining three ports of power divider 21 are respectively connected a terminal of a matched load 22, the second terminal of which is connected to a ground 28 of the circuit, and the input terminals of two dc separators 23 and 24. To output terminals of separators 23 and 24 are respectively connected one end of a line section 25 and one end of a line section 26, both featuring a characteristic impedance $Z_0=50$ ohms. The second end of line section 25 is connected to the anode of a pin diode 27, whose cathode is connected to ground 28 of the circuit, while the second end of line section 26 is connected to the cathode of a pin diode 29.

The anode of pin diode 29 is connected to a line section 30, $\lambda/4$ long and with a characteristic impedance $Z_1$ less than $Z_O$, and receives a dc bias current $I_{dc}$. The anode of pin diode 27 and the cathode of pin diode 29 are respectively connected to one end of a line section 31 and the one end of a line section 32, both $\lambda/4$ long and having a characteristic impedance $Z_T$. The second end of line section 31 is connected to the cathode of a pin diode 33. The second end of line section 32 is connected to the anode of a pin diode 34. The anode of pin diode 33 and the cathode of pin diode 34 are connected to each other and to a line section 43, $\lambda/4$ long and having a characteristic impedance $Z_1$ less than $Z_0$. The cathode of pin diode 33 and the anode of pin diode 34 are also connected to one end of a line section 35 and respetively to one end of a line section 36, both $\lambda/4$ long and having a characteristic impedance $Z_T$. The second ends of line sections 35 and 36 are respectively connected to one end of a line section 37 and te one end of a line section 38, both having a characteristic impedance $Z_O$. The second ends of line sections 37 and 38 are connected to the input terminals of two dc separators 39 and 40 respectively, whose output terminals are connected to two ports of a power divider 41 at 90° and 3 dB. The third port of power divider 41 is connected to a terminal of a matched load 42, the second terminal of which is connected to ground 28 of the circuit, while the radiofrequency output signal is available on the fourth port OUT of power divider 41.

The diagram in FIG. 3 shows the decoupling of the variable attenuator object of the present invention in its parallel configuration, as a function of the characteristic impedance $Z_T$ of line sections 8, 10, 31, 32, 35 and 36 and resistance R of pin diodes 6, 9, 27, 29, 33 and 34 in FIGS. 1 and 2.

Both circuits shown in FIGS. 1 and 2 use pin diodes connected in parallel and their operation is substantially the same. They differ from each other in that the circuit shown in FIG. 1 uses a number of components as low as possible and dissipates the reflected Power on matched load 2 through separator 1, whereas the circuit shown in FIG. 2, which uses a greater number of components has a balanced structure which permits a better signal handling and dissipates the reflected power on matched loads 22 or 42 through power dividers 41 or 21, which are by far less expensive than the separator and don't require any calibrations during the assembling operations, since they can be implemented with line sections.

During their operations, pin diodes 6 and 9 in FIG. 1 and pin diodes 27, 29, 33 and 34 in FIG. 2 are passed through by the same dc bias voltage $I_{dc}$. The intensity of current $I_{dc}$ determines the radiofrequency impedance value of the pin diodes and consequently the value of decoupling of the variable attenuator. A merit of the inventive idea is having discovered that the maximum decoupling value achievable with the variable attenuator does not only depend on the number of pin diodes used and the length of the line sections used to connect them, but also on the value of characteristic impedance of the line sections used to connect the pin diodes. As a matter of fact, it can be demonstrated with simple known mathematic calculations, which are not attached here, that the maximum decoupling achievable with the variable attenuator is as much higher as the difference between the characteristic impedance $Z_T$ of the line sections connecting the pin diodes and the characteristic impedance $Z_0$ of the circuit is greater. As a matter of fact, by looking at the diagram in FIG. 3, it can be noted that, in a circuit having a characteristic impedance $Z_0$ of 50 ohms implemented according to the technique known so far, the attenuator decoupling varies from 25 to 43 dB in correspondance to pin diode resistances ranging from 10 to 3 ohms, whereas in the circuit implemented according to the inventive idea, decouplings of more than 10 dB higher with respect to the technique known so far can be obtained, depending on the value of the characteristic impedance $Z_T$ selected.

FIG. 4, which illustrates a variable attenuator including pin diodes connected in series to each other, includes a separator 51 to the input port IN of which is fed to the radiofrequency input signal, the the central port of which a terminal of a matched load 52 is connected and to the output port of which a terminal of a dc separator 53 is connected. The second terminal of matched load 52 is connected to a ground 54 of the circuit, while the second terminal of separator 53 is connected to one end of a line section 55, whose characteristic impedance $Z_0$ is 50 ohms. The second end of line section 55 is connected to the anode of a pin diode 56 and to one end of a line section 57, $\lambda/4$ long and having a characteristic impedance $Z_2$ greater than the characteristic impedance $Z_0$ of the circuit. The second end of line section 57 is connected to one end of a line section 58, $\lambda/4$ long and having a characteristic impedance $Z_1$, less than $Z_0$, and is powered from a dc bias current $I_{dc}$. The cathode of pin diode 56 is connected to one end of a line section 59, $\lambda/4$ long and having a characteristic impedance $Z_T$, the second end of which is connected to the anode of a pin diode 60. The cathode of pin diode 60 is connected to one end of a line section 61, $\lambda/4$ long and having a characteristic impedance $Z_T$. The second end of line section 61 is connected to one end of a line section 62 also $\lambda/4$ long and with a characteristic impedance Z2 greater than $Z_0$ and to one end of a line section 63 having a characteristic impedance $Z_0$. The second end of line section 62 is connected to ground 54 of the circuit, while the second end of line section 63 is connected to a port of a dc separator 64, at the second port OUT of which the radio frequency output signal is available. In FIG. 5, which illustrates a variable attenuator using pin diodes in series according to a balanced structure, the radio frequency input signal enters a port IN of a power divider 71 at 90° and 3 dB. To the remaining three ports of power divider 71 the following elements are respectively connected: one end of a matched load 72, the second terminal of which is connected to a ground 73 of the circuit, and the input terminals of two dc separators 74 and 75. To the output terminals of separators 74 and 75 one end of a line section 76 and respectively one end of a line section 77, both having a characteristic impedance $Z_0$ of 50 Ohms, are connected. The second end of line section 76 is connected to the anode of a pin diode 78 and to one end of a line section 79, $\lambda/4$ long and with a characteristic impedance $Z_2$ greater than $Z_0$. The second end of line section 79 is connected to one end of a line section 80, $\lambda/4$ long and with a characteristic impedance $Z_1$ less than $Z_0$, and is powered from a dc bias current $I_{dc}$. The second end of line section 77 is connected to the cathode of a pin diode 81 and to one end of a line section 82, $\lambda/4$ long and with a characteristic impedance $Z_2$ greater than $Z_O$, and the second end of which is connected to ground 73 of the circuit. The cathode of pin diode 78 and the anode of pin diode 81 are respectively connected to one end of a line section 83 and to one end of a line section 84, both $\lambda/4$ long and having a characteristic impedance $Z_T$. The second end of line section 83 is connected to the anode of a pin diode 85, while the second end of line section 84 is connected to the cathode of a pin diode 86. The cathode of pin diode 85 and the anode of pin diode 86 are respectively connected to one end of a line section 87 and to one end of a line section 88, both $\lambda/4$ long and having a characteristic impedance $Z_T$. The second ends of line sections 87 and 88 are respectively connected to one end of a line section 89 and to one end of a line section 90, both $\lambda/4$ long and having a characteristic impedance $Z_2$ greater than $Z_0$. The second ends of line sections 89 and 90 are connected to each other and to on end of a line section 91, $\lambda/4$ long and with a characteristic impedance $Z_1$ less than $Z_0$. The second ends of line sections 87 and 88 are also respectively connected to one end of a line section 92 and to one end of a line section 93, both having a characteristic impedance $Z_0$, the second ends of which are connected to the input terminals of two dc separators 94 and 95. The output terminals of separators 94 and 95 are connected to two ports of a power divider 96 at 90° and 3 dB. The third port of power divider 96 is connected to the terminal of a matched load 97. The second terminal of matched load 97 is connected to ground 73 of the circuit, and the radio frequency output signal is available at the fourth port OUT of power divider 96. The diagram in FIG. 6 shows the decoupling of the variable attenuator object of the present invention in its series configuration in function of characteristic impedance $Z_T$ of line section 59, 61, 83, 84, 87 and 88 and of resistance R of pin diodes 56, 60, 78, 81, 85 and 86 in FIGS. 4 and 5. Line sections 57, 58 and 62 in FIG. 4; 79, 80, 82 and 89, 90, 91 in FIG. 5 are used to make the dc current necessary to bias the pin diodes, pass through. The $\lambda/4$ length and characteristic impedances $Z_1$ and $Z_2$, which are lower and respectively greater than characteristic impedance $Z_0$ of the circuit, have been selected in such a way that the said line sections do not affect the radio frequency signal.

In the previous figures separators 1 and 51 can be implemented by circulators; matched loads 2, 22, 42, 52, 72 and 97 can be implemented by concentrated or distributed resistors; and dc separators 3, 12, 23, 24, 39, 40, 53, 64, 74, 75, 94 and 95 can be implemented by capacitors or appropriate line sections faced to each other. The same considerations made for the circuits in FIGS. 1 and 2 are also valid for the circuits in FIGS. 4 and 5 for what concerns both the balanced or unbalanced structure and the operation, therefore the said considerations are not repeated here. It can only be noted that, by looking at the diagram in FIG. 6, in a circuit having a characteristic impedance $Z_0$ of 50 Ohms implemented according to the technique known so far, the attenuator decoupling ranges between 35 and 75 dB in correspondance to pin diode resistances ranging between 500 and 5000 Ohms, whereas in the circuit implemented according to the inventive idea decouplings of more than 10 dB higher with respect to the technique known so far can be achieved, depending on the value of the characteristique impedance $Z_T$ selected. The adavantages of the pin diode variable attenuator object of the present invention are clear from the description made. In particular, these advantages consist in that it is possible to achieve high decoupling values; in that the desired decoupling value can be achieved using a reduced number of pin diodes or reducing the dc bias current variation range with respect to the technique known so far; in that power consumptions and stresses of the pin diodes used ar decreased; in that it is possible to simplify the bias current linearizer networks and in that it is very flexible, thanks to the fact that the most appropriate value for the characteristic impedance $Z_T$ of the line section used to connect the pin diodes can be selected, in function of the decoupling values expected. It is clear that many variations are possible for the pin diode variable attenuator described as an exemple to those skilled in the art and all this may be considered as comprised in the widest scope of spirit of the invention. In one of the said possible variations, the 90° and 3 dB power dividers 21, 41, 71 and 96 can be implemented with line sections coupled at radio frequency and decoupled in dc. This solution, because of the decoupling being implemented at dc, permits to suppress the dc separators 23, 24, 39, 40, 74, 75, 94 and 95 in the circuitsshown in FIGS. 2 and 5.

I claim:

1. A microwave variable attenuator including an input and an output terminal, said input and output terminals being connected to external circuits presenting a first characteristic impedance, said microwave variable attenuator comprising:

a plurality of line sections, coupled between said input and output terminals, each presenting a second characteristic impedance different from said first characteristic impedance; and variable attenuation means connected to said line sections.

2. A variable attenuator according to claim 1, wherein: line said variable attenuation means are connected between said sections and a radio-frequency ground; and said second characteristic impedance is greater than said first characteristic impedance.

3. A variable attenuator according to claim 1, wherein:

said variable attenuation means are serially connected with said line sections; and said second characteristic impedance is smaller than said first characteristic impedance.

4. A variable attenuator according to claim 1, wherein said line sections have a length of substantially $\frac{1}{4}$ of the wavelength of the signal attenuated by the variable attenuator.

5. A variable attenuator according to claim 1, further comprising a DC separator means.

6. A variable attenuator according to claim 1, further comprising:

a separator having a first terminal coupled to said input terminal, a second terminal coupled to said line sections by means of a transmission line having said first characteristic impedance, and a third terminal coupled to a matched load, for dissipating power reflected from said variable attenuator.

7. A variable attenuator according to claim 6, wherein said separator is implemented by a circulator.

8. A variable attenuator according to claim 1, further comprising a power divider having a first terminal coupled to said input terminal, a second and a third terminal coupled to said line sections by means of transmission lines having said first characteristic impedance, and a fourth terminal coupled to a matched load, for dissipating power reflected from said variable attenuator.

9. A variable attenuator according to claim 8, wherein said power divider is a 90° and a 3 DB divider.

10. A variable attenuator according to claim 5, wherein:

said DC separator means is a capacitor.

11. A variable attenuator according to claim 5, wherein said DC separator means is a faced line section.

12. A variable attenuator according to claim 9, wherein said 90° and 3 DB power divider is implemented by a line section coupled at radio frequency and decoupled at direct current.

13. A variable attenuator according to claim 6 or 8, wherein said matched load is concentrated resistor.

14. A variable attenuator according to claim 6 or 8, wherein said matched load is distributed resistor.

15. A variable attenuator according to claim 2, wherein:

said variable attenuation is a pin diode; and said radio-frequency ground is obtained by means of a first quarter-wavelength transmission line presenting a third characteristic impedance smaller than said first characteristic impedance.

16. A variable attenuator according to claim 3 further comprising:

a first open transmission line, coupled to said line sections, including a first quarter-wavelength component section, presenting a fourth characteristic impedance smaller than said first characteristic impedance, and a second quarter-wavelength component section presenting a fifth characteristic impedance greater than said first characteristic impedance; and a second quarter-wavelength transmission line, coupled between said line sections and ground, presenting said fifth characteristic impedance; wherein:

said variable attenuation means is a pin diode.

* * * * *